US005129375A

United States Patent [19]

Takane et al.

[11] Patent Number: 5,129,375

[45] Date of Patent: Jul. 14, 1992

[54] IDLER ATTACHING BOSS CONSTRUCTION

[75] Inventors: Yoshikazu Takane; Yasuyuki Matsuno, both of Iwata, Japan

[73] Assignee: Yamaha Hatsudoki Kabushiki Kaisha, Iwata, Japan

[21] Appl. No.: 683,598

[22] Filed: Apr. 9, 1991

[51] Int. Cl.[5] ..... F01L 1/02

[52] U.S. Cl. ..... 123/90.31; 123/195 C

[58] Field of Search ..... 123/90.27, 90.31, 195 C, 123/198 E

[56] References Cited

U.S. PATENT DOCUMENTS

| | | | |
|---|---|---|---|
| 3,361,000 | 1/1968 | Buchwald | 123/90.31 |
| 3,482,553 | 12/1969 | Buchwald | 123/90.31 |
| 4,607,601 | 8/1986 | Kohler | 123/90.31 |
| 4,750,455 | 6/1988 | Ebesu | 123/90.31 |
| 4,944,264 | 7/1990 | Murasaki et al. | 123/195 C |
| 4,951,616 | 8/1990 | Aruga et al. | 123/90.31 |
| 4,971,000 | 11/1990 | Shimura et al. | 123/90.31 |

FOREIGN PATENT DOCUMENTS

| | | | |
|---|---|---|---|
| 208504 | 8/1989 | Japan | 123/90.31 |
| 211327 | 8/1990 | Japan | 123/90.31 |

*Primary Examiner*—E. Rollins-Cross
*Assistant Examiner*—Weilun Lo
*Attorney, Agent, or Firm*—Ernest A. Beutler

[57] ABSTRACT

An accessory drive arrangement for an internal combustion engine having belt driven overhead camshafts contained within a belt cover. An accessory mounting boss is affixed to the engine within the belt cover and has a boss portion that extends through the belt cover and which journals an accessory drive idler pulley.

6 Claims, 4 Drawing Sheets

IDLER ATTACHING BOSS CONSTRUCTION

BACKGROUND OF THE INVENTION

This invention relates to an idler attaching boss construction and more particularly to an improved arrangement for driving an accessory from an engine.

In engines having one or more overhead camshafts, it is a current practice to employ a timing belt rather than a timing chain for driving the camshaft. There are a number of advantages to the use of timing belts over timing chains, which advantages are well known. When a timing belt rather than a timing chain is employed, the belt is positioned externally of the outer walls of the engine, normally at the front of the engine. In order to protect the belt, it is the practice to attach some form of belt cover to the front wall of the engine so as to enclose at least partially the belt and the various sprockets or pulleys which drive or are driven by it. These belt covers are normally formed from a lightweight material, such as a molded plastic.

In addition to driving the camshaft or camshafts from the engine output shafts, it is also the practice to drive a plurality of accessories. These accessory drive arrangements are normally positioned outside of the belt cover and may power such accessories as power steering pumps, air conditioning compressors, alternators or the like. When the camshaft drive is enclosed by a lightweight belt cover, then it is necessary to mount the accessories and the idler pulleys therefore in a rigid manner from the front of the engine. However, this means, in conventional practice, that the drive pulleys and idler pulleys for the accessories must all have their rotational axes disposed outside of the periphery of the belt cover. This gives rise to long belt flights and the problems attendant thereto.

It is, therefore, a principal object of this invention to provide an improved idler attaching boss construction that permits the driving of an accessory or an idler pulley for an accessory that has an axis of rotation that is disposed within the peripheral confines of a belt cover, but which nevertheless is rigidly supported.

It is a further object of this invention to provide an improved arrangement for driving accessories from an engine having one or more belt driven camshafts.

SUMMARY OF THE INVENTION

This invention is adapted to be embodied in an accessory drive idler attachment for an internal combustion engine that is comprised of a cylinder block and attached cylinder head that define a front wall. An output shaft extends through the front wall and has a pulley attached thereto forwardly of the front wall. A camshaft is journaled in the cylinder head and extends through the front wall. A pulley is affixed to the camshaft forwardly of the front wall. A flexible drive belt drives the camshaft pulley from the engine output shaft pulley. A belt cover is affixed to the front wall and at least partially encloses the camshaft and output shaft pulleys and the drive belt. An idler journal member is affixed to the front wall within the belt cover and has a boss portion that extends through a complementary opening in the belt cover. An accessory idler pulley is journaled for rotation on the boss and has an axis of rotation that is disposed within the peripheral edges of the belt cover.

DETAILED DESCRIPTION OF THE PREFERRED EMBODIMENT OF THE INVENTION

Figure 1:
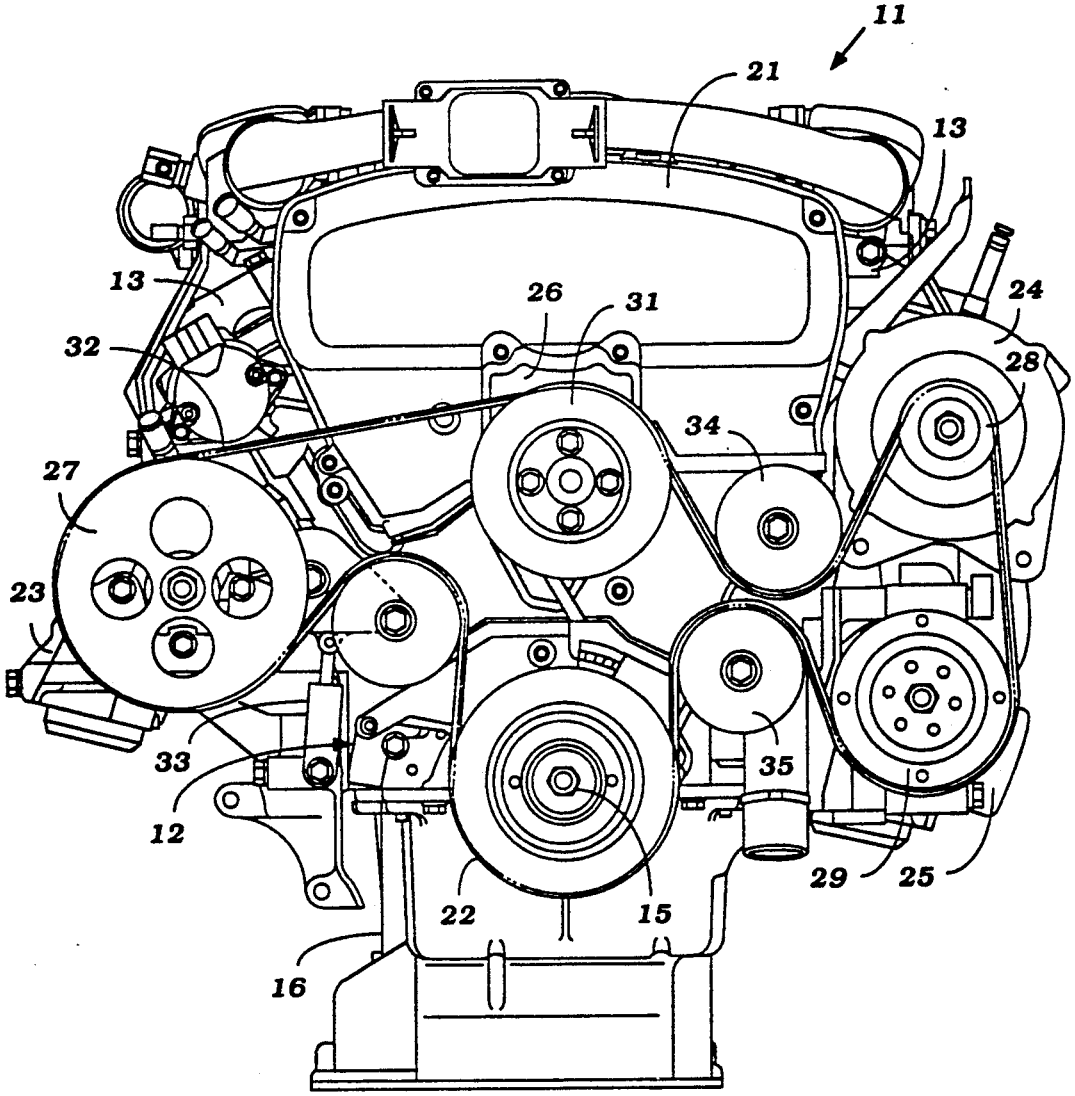
FIG. 1 is a front elevational view of an internal combustion engine having an accessory drive idler attaching boss construction constructed in accordance with an embodiment of the invention.
Figure 2:
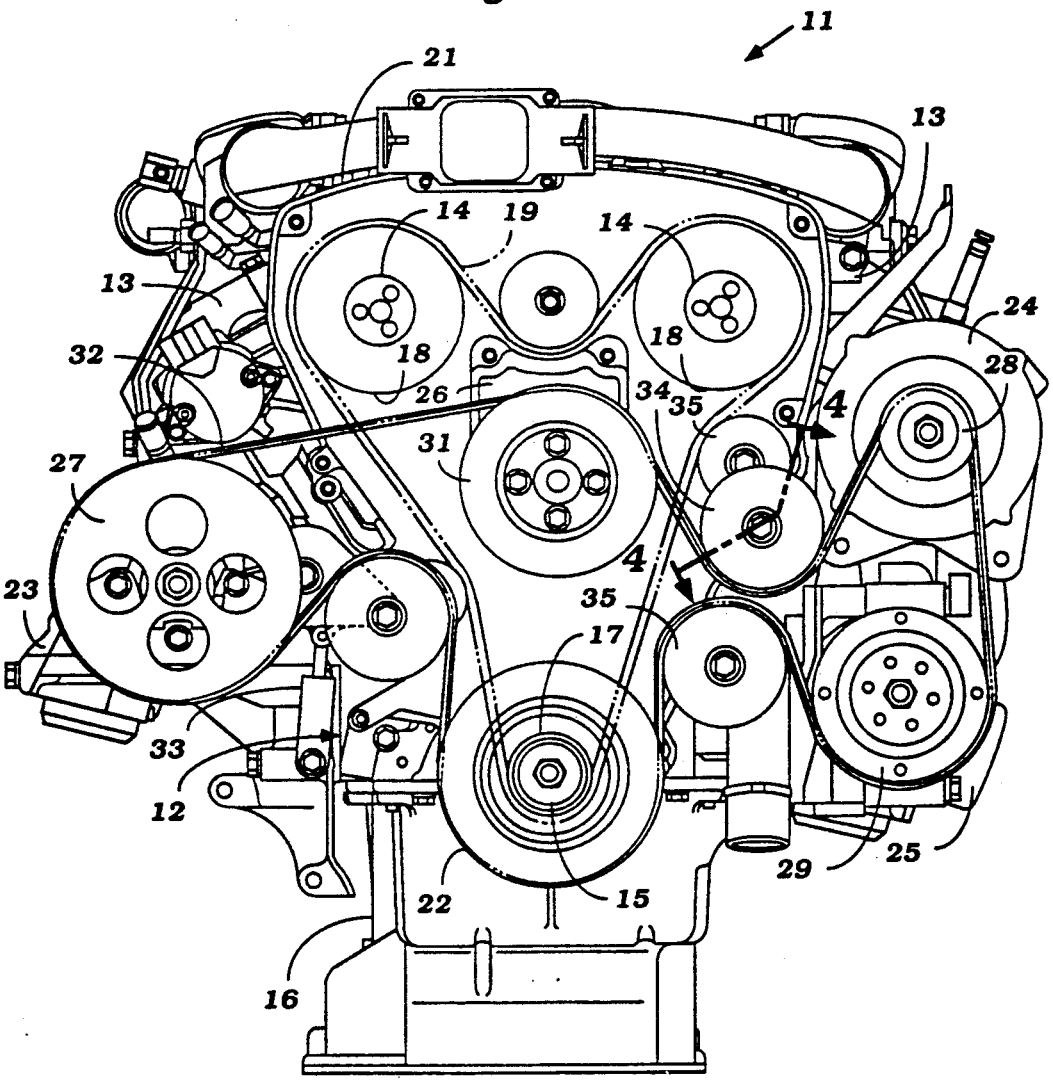
FIG. 2 is a further front elevational view, in part similar to FIG. 1, showing the belt cover partially removed to illustrate the belt cover for driving the camshafts.

Referring now in detail to the drawings, an internal combustion engine having an accessory drive system constructed in accordance with an embodiment of the invention is identified generally by the reference numeral 11. The engine 11 is, in the illustrated embodiment, of the V-8 type. It is to be understood that the invention may be utilized in conjunction with V type engines having in other numbers of cylinders or with in line engines. The engine 11 is, in the illustrated embodiment, designed for an automotive application and particularly one in which the engine 11 is positioned transversely in the engine compartment, as is typical with transverse engine front wheel drive applications. Obviously, the invention can be employed in conjunction with other applications for internal combustion engines.

Since the invention relates primarily to the accessory drive arrangement and its relationship to the camshaft drive, only the external construction of the engine 11 has been illustrated. The engine 11 is comprised of a cylinder block, indicated generally by the reference numeral 12, to which a pair of cylinder heads 13 are affixed in a known manner so as to define the cylinder banks for the engine. The engine is provided with an overhead camshaft arrangement and this may include camshafts 14 each of which is journaled by a respective one of the cylinder heads 13 in a known manner and which extend through a front wall defined by the cylinder block 12 and cylinder head 13.

In a like manner, a crankshaft 15 is journaled in the cylinder block 12 and is enclosed within a crankcase chamber defined by an oil pan 16 and the lower portion of the cylinder block 12. The crankshaft 14 has a portion that extends through this front wall and to which a camshaft drive sprocket 17 is affixed. Similar driven sprockets 18 are affixed to the forward ends of the camshafts 14 and a toothed driving belt 19 drives the camshafts 14 from the crankshaft 15.

A belt cover, indicated generally by the reference numeral 21 and which may be formed from a lightweight molded plastic is affixed to the front wall of the engine in a known manner and encloses the sprockets 17, 18 and drive belt 19.

In addition to the camshaft drive sprocket 17, an accessory drive pulley 22 is affixed to the crankshaft 15. This pulley may include a torsional vibration damper of a known type. The accessory drive pulley 22 is positioned forwardly of the belt cover 21. A plurality of engine driven accessories are driven from this drive pulley 22 and these may include an air conditioning compressor 23, an alternator 24 and a power steering pump 25. In addition, a water pump 26, which is mounted within the belt cover 21, may be driven from the pulley 22. Respective driven pulleys 27, 28, 29 and 31 are affixed to the input shafts of the aforenoted accessories. A drive belt 32 engages the drive pulley 22 and driven pulleys 27, 28, 29 and 31 for driving these accessories. A combined tensioner/damper assembly 33 is mounted at one side of the engine and beyond the outer periphery of the belt cover 21 for tensioning the belt 32.

Figure 3:
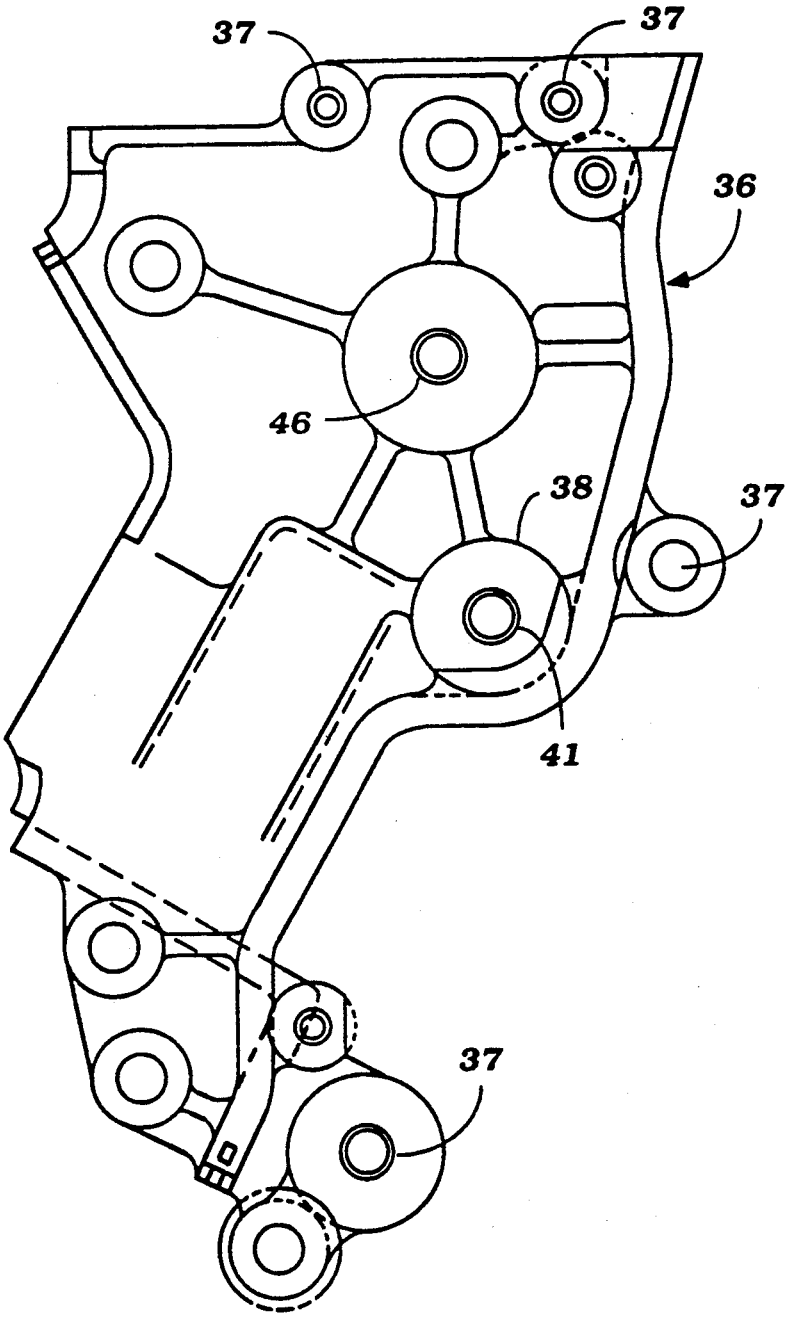
FIG. 3 is an enlarged front elevational view of the idler attaching boss construction.
Figure 4:
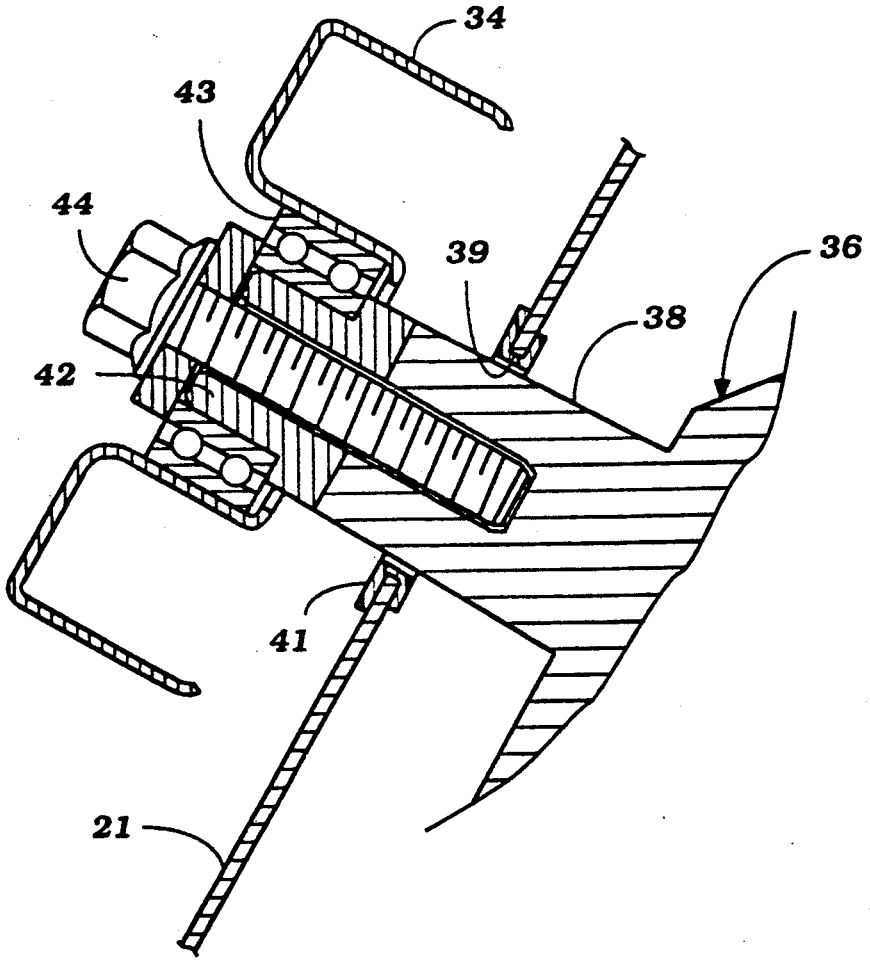
FIG. 4 is an enlarged cross sectional view taken along the line 4—4 of FIG. 2.

It is desirable to provide further idler pulleys 34 and 35 for maintaining the belt 32 in engagement with the various pulleys and to direct its path of travel. With conventional engines having conventional belt covers, all such pulleys must be mounted beyond the periphery of the belt cover 21. This somewhat compromises the belt and driving arrangement. In accordance with the invention, however, an idler attaching boss, indicated generally by the reference numeral 36 (FIGS. 3 and 4) is affixed by means of mounting bolts that pass through a plurality of apertures 37 formed therein for affixing the mounting boss 36 to the aforenoted front wall and specifically to the cylinder block thereof. The mounting boss 36 has an extending boss portion 38 which extends through a complementary aperture 39 formed in the belt cover 21 with a seal 41 surrounding it. The boss portion 38 extends within the peripheral edges of the belt cover 31 and has a journaling bushing 42 on the outer end thereof which receives an anti friction bearing 43 held in place by a bolt 44 for journaling the idler pulley 34. As a result of this construction, the axis of rotation of the idler pulley 34 may be positioned inwardly of the outer peripheral edges of the belt cover 21 and yet provide a very rigid support for the idler pulley 34.

In addition, other pulleys such as an idler pulley 45 for the camshaft drive belt 19 may be journaled on a further boss 46 of the mounting boss 37.

It should be readily apparent from the foregoing description that the mounting arrangement provides a very rigid mounting for the idler pulleys that can be positioned within the outer peripheral edge of the timing belt without weakening the mount therefore. Of course, the foregoing description is that of a preferred embodiment of the invention. Various changes and modifications may be made without departing from the spirit and scope of the invention, as defined by the appended claims.

We claim:

1. An accessory drive idler attachment for an internal combustion engine comprised of a cylinder block and attached cylinder head defining a front wall, an output shaft extending through said front wall and having a pulley affixed thereto forwardly of said front wall, a camshaft journaled in said cylinder head and extending through said front wall, a pulley affixed to said camshaft forwardly of said front wall, a flexible drive belt for driving said camshaft pulley from said engine output shaft pulley, a belt cover affixed relative to said front wall and at least partially enclosing said camshaft and crankshaft pulleys and said drive belt, an idler journal member affixed to said front wall and having a boss portion extending through a complementary opening in said belt cover, and an accessory idler pulley journaled by said boss for rotation about an axis disposed within the outer peripheral edges of the belt cover.

2. An accessory drive idler attachment as set forth in claim 1 further including an accessory drive pulley affixed to the output shaft forwardly of the belt cover and driving a plurality of accessories and the idler pulley.

3. An accessory drive idler attachment as set forth in claim 1 wherein the belt cover is formed from a plastic material.

4. An accessory drive idler attachment as set forth in claim 1 wherein the engine has a pair of cylinder banks and a cylinder head and camshaft affixed to each of the cylinder banks and driven by the drive belt.

5. An accessory drive idler attachment as set forth in claim 4 further including an accessory drive pulley affixed to the output shaft forwardly of the belt cover and driving a plurality of accessories and the idler pulley.

6. An accessory drive idler attachment as set forth in claim 5 wherein the belt cover is formed from a plastic material.

* * * * *